US011047243B2

(12) United States Patent
Ko

(10) Patent No.: US 11,047,243 B2
(45) Date of Patent: Jun. 29, 2021

(54) GAS TURBINE BLADE

(71) Applicant: DOOSAN HEAVY INDUSTRIES & CONSTRUCTION CO., LTD., Changwon-si (KR)

(72) Inventor: Min Seok Ko, Gimhae-si (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 231 days.

(21) Appl. No.: 15/853,964

(22) Filed: Dec. 26, 2017

(65) Prior Publication Data

US 2018/0187555 A1 Jul. 5, 2018

(30) Foreign Application Priority Data

Jan. 3, 2017 (KR) ..... 10-2017-0000694

(51) Int. Cl.
*F01D 5/18* (2006.01)
*F01D 9/06* (2006.01)

(52) U.S. Cl.
CPC ..... *F01D 5/187* (2013.01); *F01D 9/065* (2013.01); *F05D 2220/32* (2013.01); *F05D 2250/75* (2013.01); *F05D 2260/22141* (2013.01)

(58) Field of Classification Search
CPC . F01D 5/186; F01D 5/187; F05D 2260/22141
See application file for complete search history.

(56) References Cited

U.S. PATENT DOCUMENTS

| | | | | |
|---|---|---|---|---|
| 5,536,143 | A * | 7/1996 | Jacala | F01D 5/187 416/96 R |
| 7,373,778 | B2 * | 5/2008 | Bunker | F01D 25/12 431/351 |
| 9,314,838 | B2 * | 4/2016 | Pointon | F01D 5/187 |
| 2015/0300201 | A1 * | 10/2015 | Koonankeil | F01D 5/187 415/116 |
| 2017/0226885 | A1 * | 8/2017 | Clum | F01D 11/08 |
| 2020/0240275 | A1 * | 7/2020 | Mongillo, Jr. | F01D 5/187 |

FOREIGN PATENT DOCUMENTS

| | | | |
|---|---|---|---|
| JP | 11241602 | A | 9/1999 |
| JP | 4738176 | B2 | 8/2011 |

* cited by examiner

*Primary Examiner* — Courtney D Heinle
*Assistant Examiner* — Andrew Thanh Bui
(74) *Attorney, Agent, or Firm* — Invenstone Patent, LLC

(57) ABSTRACT

Disclosed herein is a gas turbine blade. The gas turbine blade includes a guide portion disposed adjacent to a direction-changing portion to guide the flow direction of cooling air in order to enhance the cooling efficiency of the turbine blade and promote the stable flow of the cooling air in a cooling passage.

20 Claims, 8 Drawing Sheets

[FIG. 1]
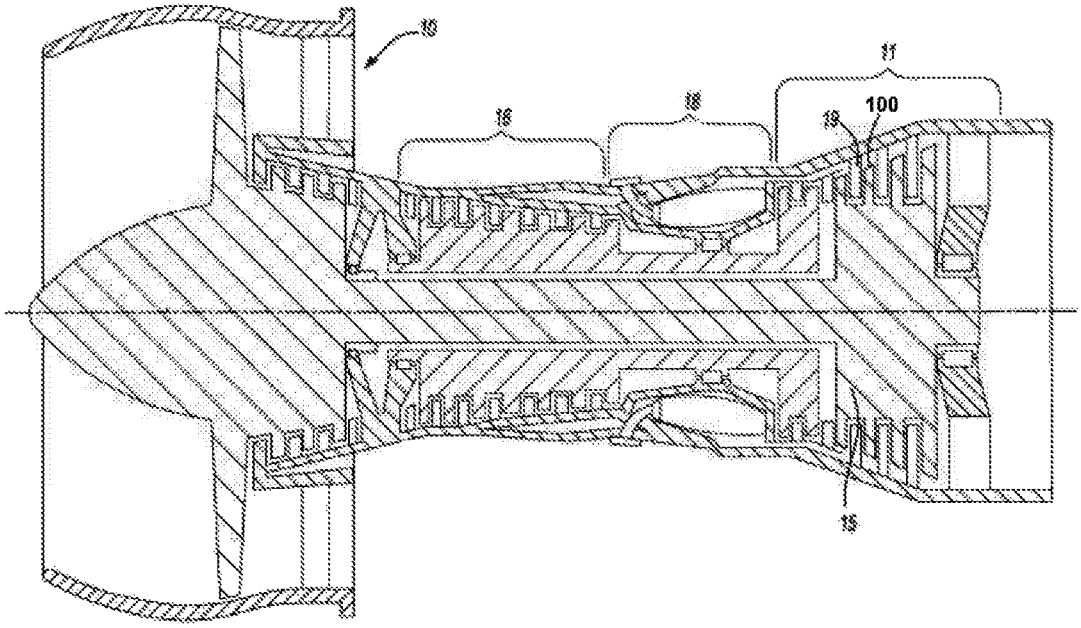

[FIG. 2]
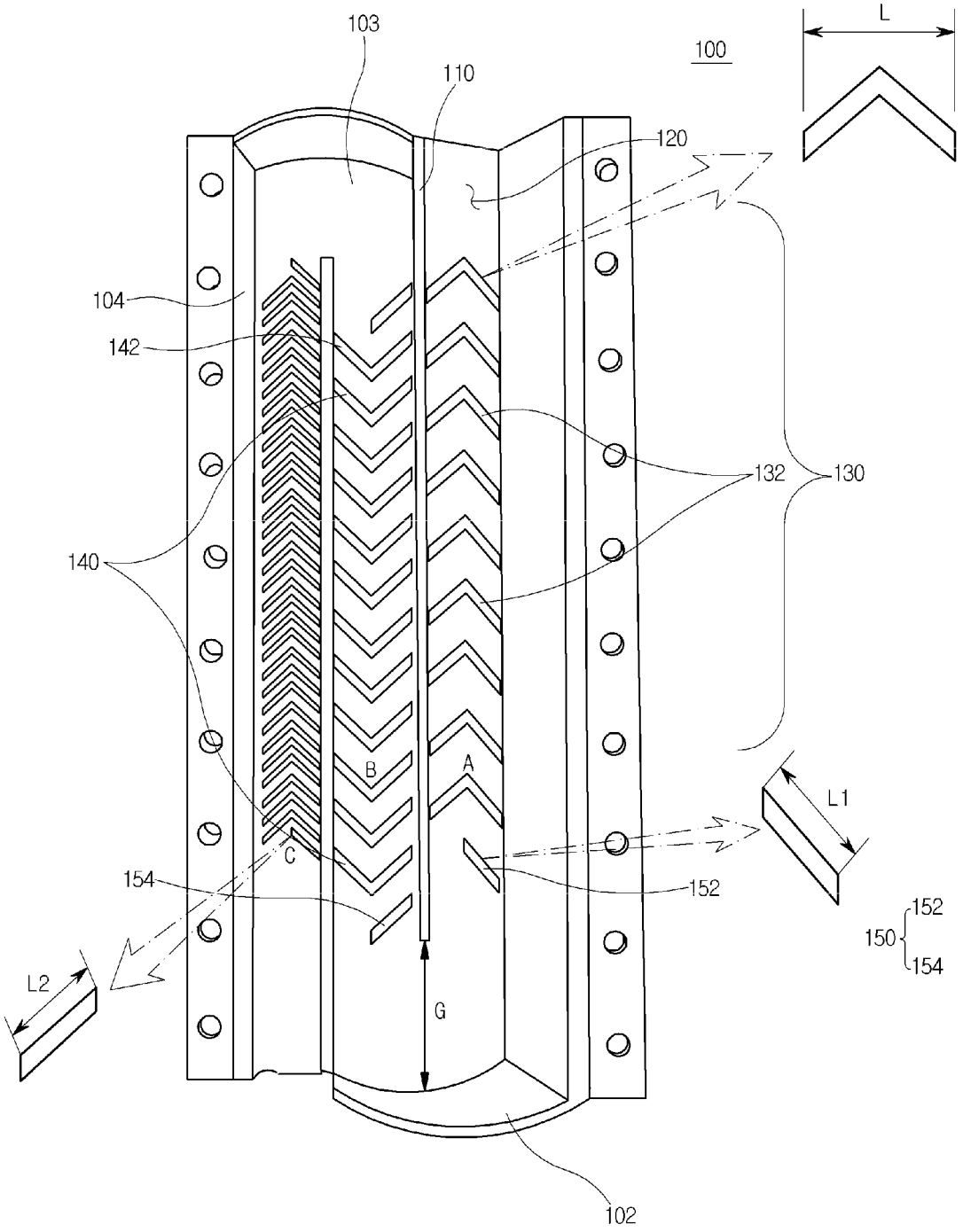

[FIG. 3]
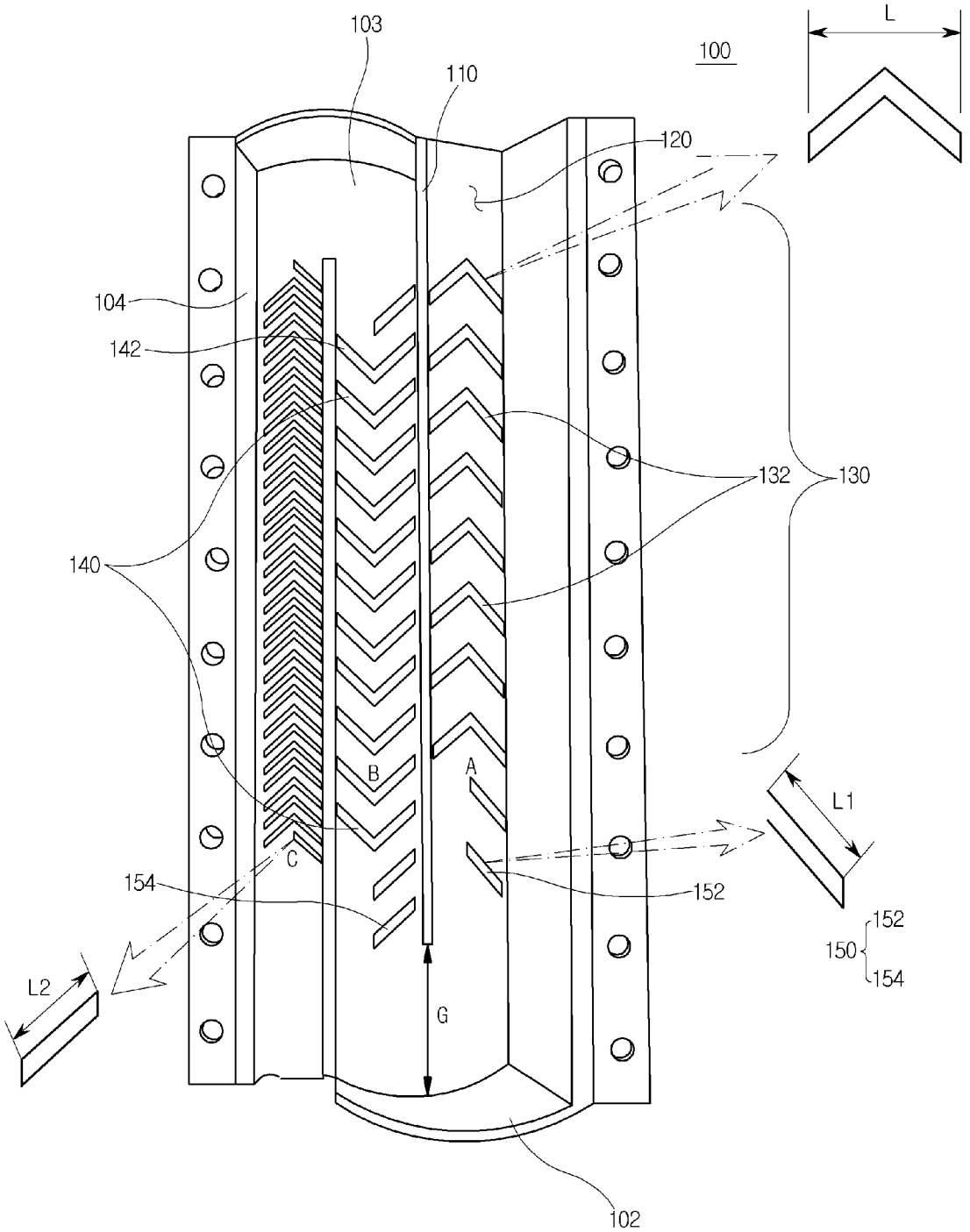

[FIG. 4]
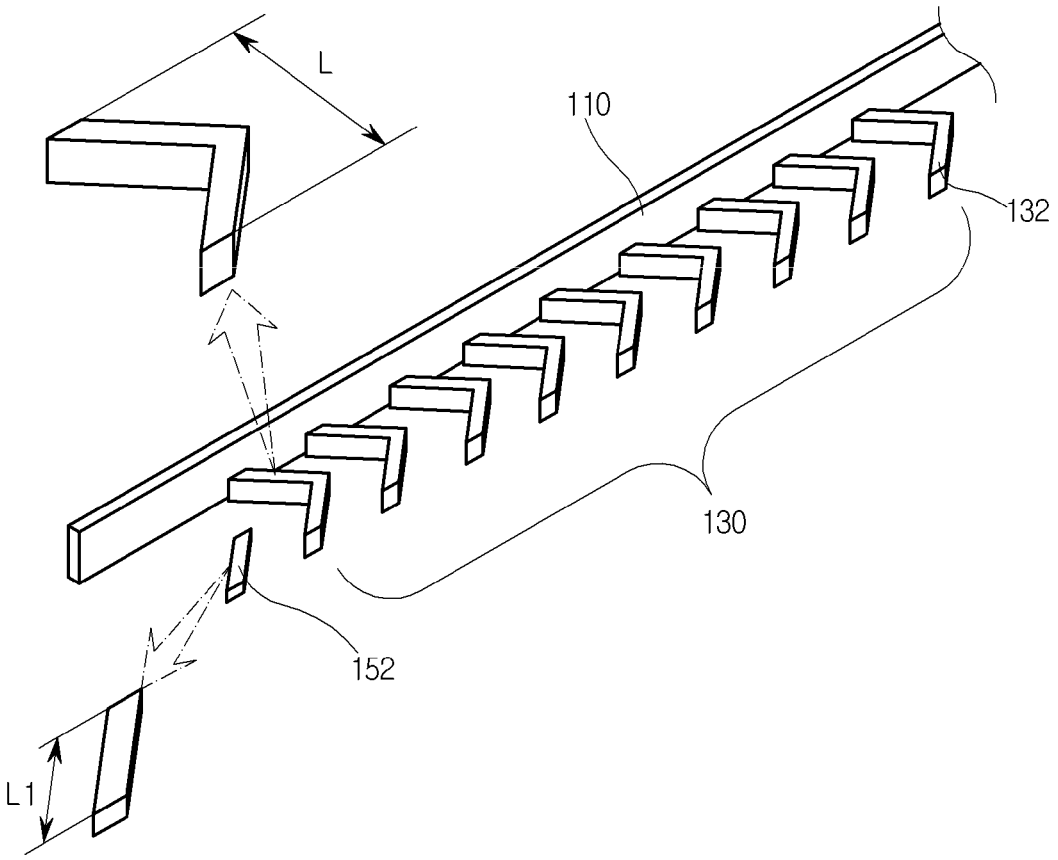

[FIG. 5]
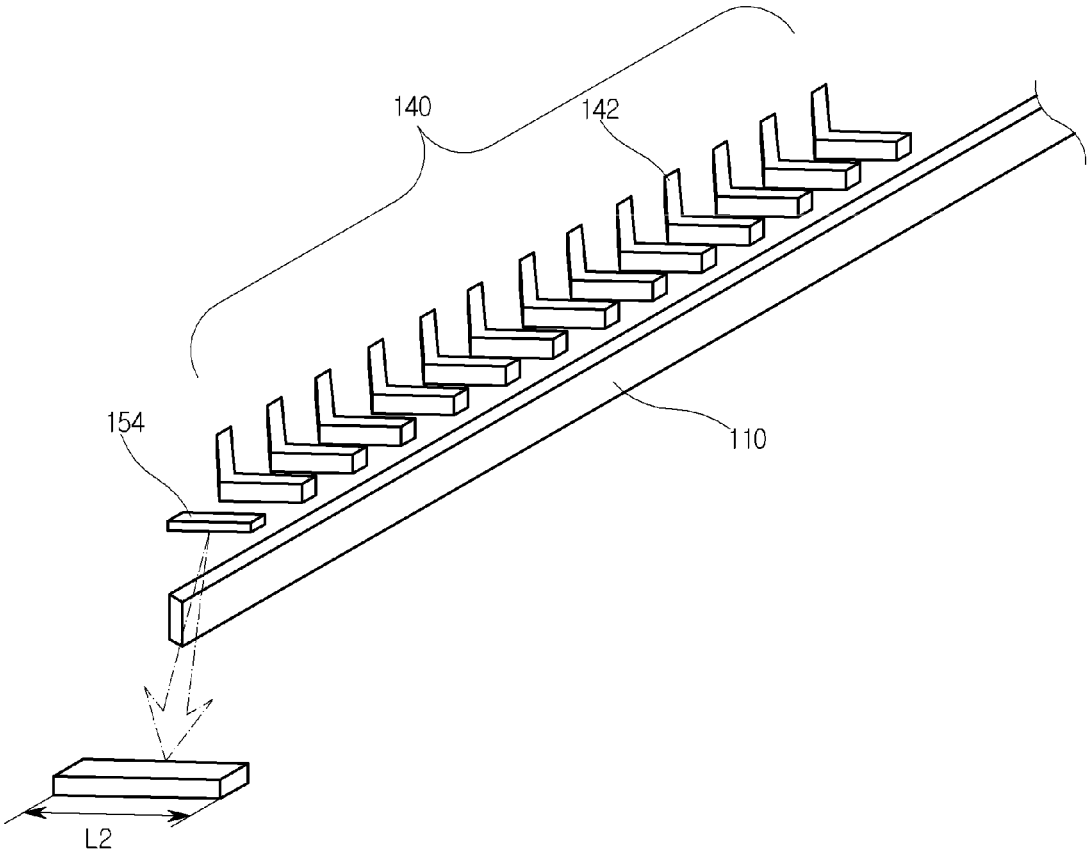

[FIG. 6]
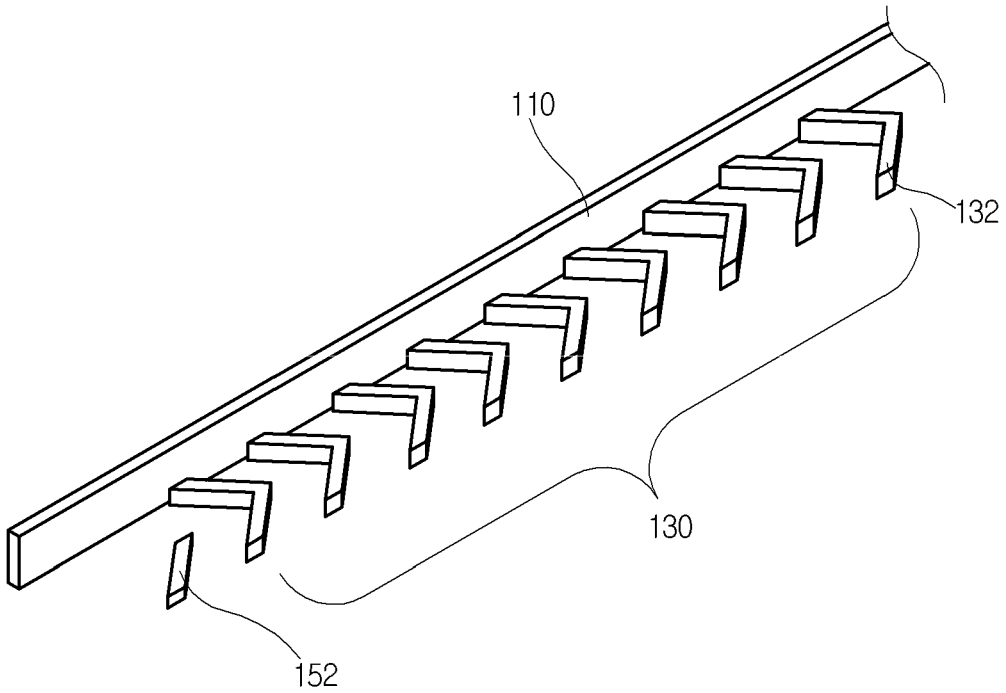

[FIG. 7]
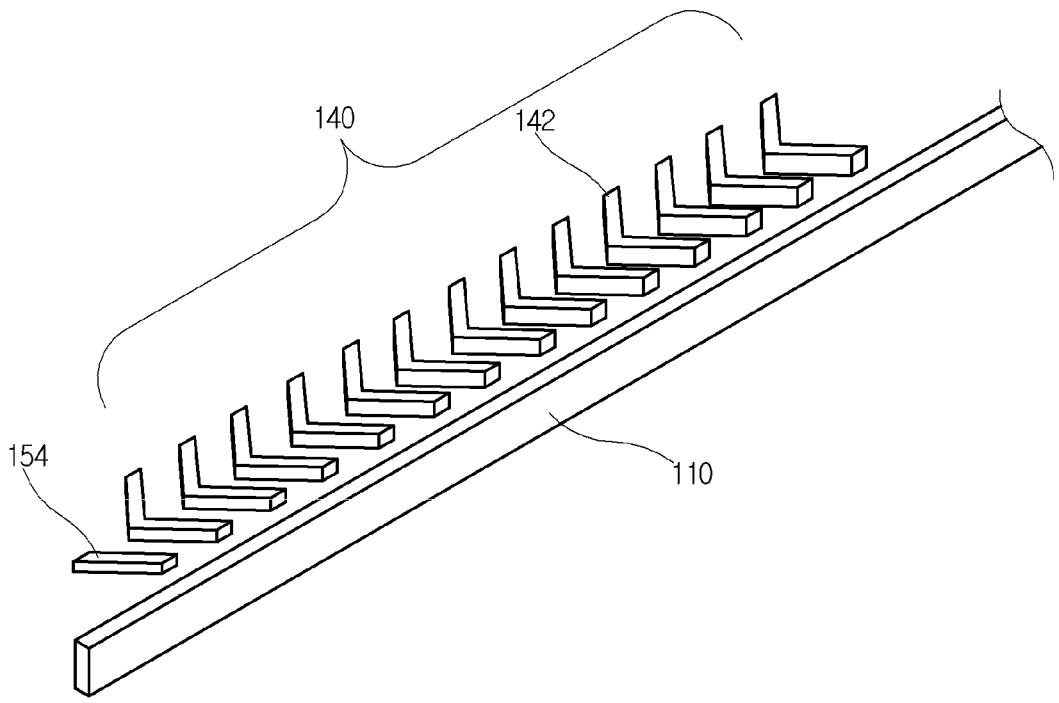

[FIG. 8]
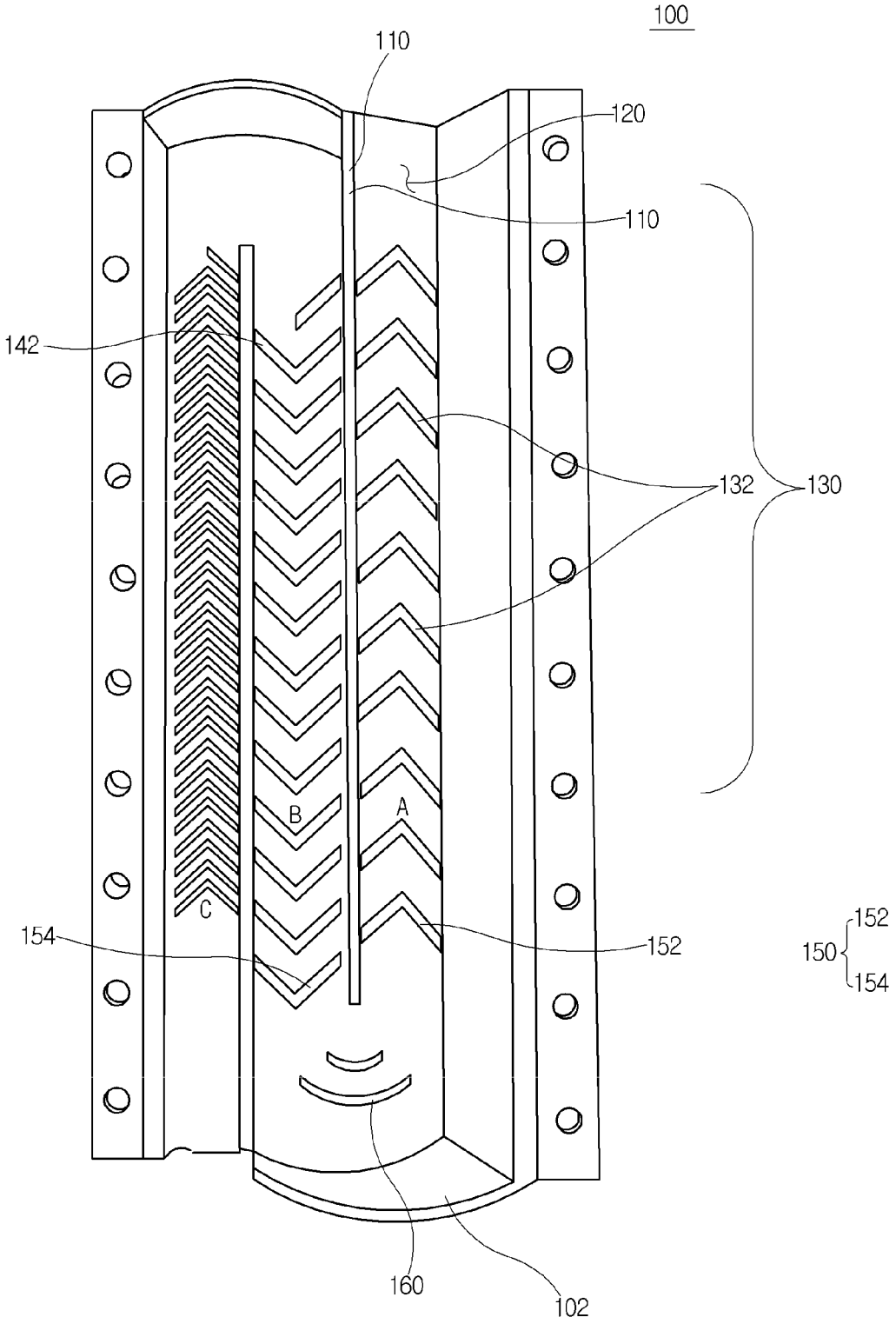

GAS TURBINE BLADE

CROSS-REFERENCE(S) TO RELATED APPLICATIONS

This application claims priority to Korean Patent Application No. 10-2017-0000694, filed on Jan. 3, 2017 the disclosure of which is incorporated by reference in its entirety.

BACKGROUND OF THE INVENTION

Field of the Invention

Exemplary embodiments of the present invention relate to a gas turbine blade capable of minimizing heat loss in a direction-changing portion, which allows the direction of cooling air flowing through a cooling passage formed in the turbine blade to be efficiently changed so as to enhance the cooling performance of the turbine blade while promoting the stable flow of the cooling air.

Description of the Related Art

In general, a variety of methods to increase the temperature at the inlet of a gas turbine have been proposed in order to enhance the performance of the gas turbine. However, the increase in temperatures at the inlet of the turbine enlarges the thermal load of a turbine blade, which eventually shortens its life.

In particular, due to the thermal load that is structurally generated in the turbine blade, the method of forcibly cooling the turbine blade by supplying a cooling fluid thereto is carried out.

This forced cooling method is a method of supplying a cooling fluid, which is discharged from a compressor of a turbine, to a blade through a passage within the blade, and of generating forced convection to cool the blade. In the cooling method using forced convection, an uneven profile is used to enhance cooling performance. The uneven profile is used to disturb the flow in the passage for an improvement in heat transfer.

A plurality of bar-shaped ribs are conventionally arranged in an inclined state in a cooling path within a blade for cooling thereof. However, cooling performance may vary depending on the angle of inclination of each of the ribs.

Especially, the cooling path formed in the blade is a U-shaped round curved pipe. Thus, when cooling air flows via the curved pipe, a vortex is formed in the curved pipe due to the drop in pressure or the separation of the cooling air, which may lead to a secondary flow.

Hence, the stable flow of cooling air may be disturbed according to the arrangement of the ribs at the position in which the flow direction of the cooling air is sharply changed in the curved pipe within the blade, additionally resulting in a reduction in cooling efficiency. Therefore, there is a need for measures to deal with them.

SUMMARY OF THE INVENTION

An object of the present invention is to provide a gas turbine blade capable of having improved cooling efficiency by stably maintaining the flow of cooling air in a section in which the cooling air flowing along a cooling passage of the turbine blade flows via a direction-changing portion.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with an aspect of the present invention, a gas turbine blade includes a plurality of cooling passages formed by a partition wall partitioning an internal region of the turbine blade, a direction-changing portion allowing for a change of direction of cooling air flowing along the cooling passages, a first rib unit having a plurality of unit ribs bent in the direction of the cooling air flowing along the cooling passages, a second rib unit having a plurality of unit ribs bent in the direction of the cooling air flowing via the direction-chaining portion, and a guide portion facing the direction-changing portion to guide the flow of the cooling air.

Each of the unit ribs of the first and second rib units may have a V shape.

The guide portion may include a first guide portion facing the direction-changing portion in the first rib unit, and a second guide portion facing the direction-changing portion to guide the flow direction of the cooling air, which passes through the first guide portion, to the second rib unit.

The first and second guide portions may have a shorter length than the constituent unit ribs of the first and second rib units.

When the first guide portion has a length of L1 and each of the constituent unit ribs of the first rib unit has a length of L, the length of L1 may be equal to a length of L/2 (L1=L/2).

When the second guide portion has a length of L2 and each of the constituent unit ribs of the second rib unit has a length of L, the length of L2 may be equal to a length of L/2 (L2=L/2).

The first and second guide portions may form an angle between 30° and 60° with an inner wall of the turbine blade.

The first and second guide portions may be disposed inside an end of the partition wall facing the direction-changing portion.

The first guide portion may consist of a plurality of first guide portions that face the direction-changing portion and are spaced apart from each other.

The second guide portion may consist of a plurality of second guide portions that face the direction-changing portion and are spaced apart from each other.

The first guide portion may have the same protruding height as or a lower protruding height than the constituent unit ribs of the first rib unit.

The first rib unit may have a reduced protruding height as it is close to the first guide portion.

The second guide portion may have the same protruding height as or a lower protruding height than the constituent unit ribs of the second rib unit.

The cooling passage in which the second rib unit is disposed may have a smaller width than the cooling passage in which the first rib unit is disposed.

The unit ribs of the second rib unit may have a reduced protruding height in the flow direction of the cooling air from the second guide portion.

The second rib unit may have relatively more unit ribs than the first rib unit.

The direction-changing portion may have an auxiliary rib to guide the flow of the cooling air passing through the first guide portion.

The auxiliary rib may have a curvature corresponding to the rounded curvature of the direction-changing portion.

The auxiliary rib may consist of a plurality of auxiliary ribs having different lengths.

The auxiliary rib may be spaced apart from an end of the partition wall.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a cross-sectional view schematically illustrating a gas turbine according to an embodiment of the present invention;

FIG. 2 is a view illustrating an internal configuration of a gas turbine blade according to an embodiment of the present invention;

FIG. 3 is a view illustrating an internal configuration of a gas turbine blade according to another embodiment of the present invention;

FIG. 4 is a perspective view illustrating arrangement of a first rib unit and a first guide portion according to an embodiment of the present invention;

FIG. 5 is a perspective view illustrating arrangement of a second rib unit and a second guide portion according to an embodiment of the present invention;

FIGS. 6 and 7 are perspective views illustrating exemplary first and second guide portions according to an embodiment of the present invention; and FIG. 8 is a view illustrating an auxiliary rib according to an embodiment of the present invention.

DESCRIPTION OF SPECIFIC EMBODIMENTS

Exemplary embodiments of the present invention will be described below in more detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention.

Hereinafter, a gas turbine blade according to exemplary embodiments of the present invention will be described with reference to the accompanying drawings.

Referring to FIGS. 1 to 3, a gas turbine 10 includes a compressor 16, a combustor 18, and a turbine 11. The gas turbine 10 mixes air compressed by the compressor 16 with fuel for combustion in the combustor 18 and the fuel is expanded by the turbine 11.

The turbine 11 includes a rotor 15 that drives the compressor 16 and a fan, and the rotor 15 further includes a blade 100 and a vane 19.

The blade 100 has an airfoil shape and a dovetail is formed at the lower side of the blade 100 as shown in FIG. 1. The turbine blade 100 has a plurality of cooling passages 120 formed by a partition wall 110 partitioning the internal region of the blade 100.

The blade 100 includes a direction-changing portion 102 that allows a flow direction of cooling air flowing through the cooling passages 120 to be changed, a first rib unit 130 having a plurality of unit ribs 132 bent in the direction of the cooling air flowing through the cooling passages 120, a second rib unit 140 that has a plurality of unit ribs 142 bent in the direction of the cooling air flowing through the direction-chaining portion 102, and a guide portion 150 provided in a portion adjacent to the direction-changing portion 102 to guide the cooling air.

The blade 100 has a void space and the partition wall 110 partitioning the internal region thereof into a plurality of spaces. The partition wall 110 partitions the internal region by a predetermined width for the flow of cooling air.

The first and second rib units 130 and 140 are disposed in the cooling passages 120, which is partitioned by the partition wall 110, and they are repeatedly disposed according to the number of cooling passages.

For example, when the blade 100 has a plurality of cooling passages 120 therein, on the basis of the flow direction of the cooling air, the first rib unit 130 is disposed in position A, the second rib unit 140 is disposed in position B via the direction-changing portion 102, and another rib unit of which bending direction is similar to the bending direction of the first rib 130 may be disposed in position C.

The cooling air, for example, serves to cool the blade 100 while flowing through the first and second rib units 130 and 140.

In order to efficiently use the cooling air in the limited internal space, the first and second rib units 130 and 140 are provided in the cooling passages 120. The first and second rib units 130 and 140 further include the unit ribs 132 and 142, respectively, having, for example, a V-shape.

Referring to FIGS. 1 to 3, the unit ribs 132 and 142 may have different lengths depending on the width of the cooling passage 120 associated therewith, and each may have, for example, a length illustrated in the drawing.

The direction-changing portion 102 may have, for example, a U-shape.

When the unit ribs 132 and 142 have a V-shape, the unit ribs 132 and 142 may not be installed in the direction-changing portion 102 to improve heat transfer efficiency and maintain stable air flow.

For example, since the cooling air passes through the position A and then flows at a right angle toward the cooling passage in position B through the direction-changing portion 102, the flow direction of the cooling air is sharply changed. Therefore, if the V-shaped unit rib is disposed in the direction-changing portion 102, it may deteriorate the stable air flow there through.

The guide portion 150 including a first guide portion 152 and a second guide portion 154 is aimed at enhancing the cooling efficiency of the cooling air to eventually enhance the cooling efficiency of the turbine blade while obtaining the drop in pressure and the stable flow of the cooling air.

The guide portion 150 includes a first guide portion 152 and a second guide portion 154. The first guide portion 152 is disposed near the direction-changing portion 102 in the first rib unit 130, and the second guide portion 154 is disposed the direction-changing portion 102 to guide the flow direction of the cooling air, which passes through the first guide portion 152 to the second rib unit 140.

The first guide portion 152 is positioned at an end portion of the partition wall 110, which is adjacent to the direction-changing portion 102 and partitions between the first rib unit 130 and the second rib unit 140.

The direction-changing portion 102 may be configured to be rounded outward from the inside of the blade 100 in a streamlined form. Although the direction-changing portion 102 is rounded as illustrated in the drawings, it is not limited thereto and may be modified into various curvatures and forms according to a flow trajectory of the cooling air.

The first and second guide portions 152 and 154 have a shorter length than the unit ribs 132 and 142 of the first and second rib units 130 and 140, respectively, to prevent any disturbances of the cooling air flow.

In addition, the first and second guide portions 152 and 154 enables the cooling air to come into contact with an inner lower portion 103, an upper surface (not shown), or a side surface 104 of the cooling passage, thereby increasing a contact surface area of the cooling air to enhance the cooling efficiency. Accordingly, the cooling air passes through the first and second guide portions 152 and 154 so as to stably flow toward the second rib unit 140.

When cooling air serves to cool the blade 100 while flowing through the cooling passage 120, the first and second guide portions 152 and 154 function as determining the flow direction of the cooling air. The drop position of the cooling air may include the inner lower portion 103, upper surface (not shown), and the side surface 104 of the cooling passage 120.

For example, although the drop position of the cooling air may be varied depending on the outward protruding height of each of the first and second guide portions 152 and 154 in the associated cooling passage 120, the blade 100 can be cooled when the cooling air flows through the first and second guide portions 152 and 154 and then drop to the desired position.

However, since the direction-changing portion 102 may have a U-shape or semicircular shape in section, the flow direction of cooling air may be sharply changed. Therefore, the V-shaped unit ribs 132 and 142 may not be installed in the direction-changing portion 102.

Since the first and second guide portions 152 and 154 have a bar shape as illustrated in FIGS. 2 and 3, most cooling air is guided to flow to the direction-changing portion 102. Thus, the blade 100 can be effectively cooled due to the stable flow of the cooling air.

In addition, the first and second guide portions 152 and 154 are rectilinearly extending, instead of being bent, and have a shorter length than the unit ribs 132 and 142 to efficiently guide the flow of the cooling air.

Referring to FIG. 2 or 4 and 5, when the first guide portion 152 has a length of L1 and each of the unit ribs 132 of the first rib unit 130 has a length of L in an embodiment, the length of L1 is equal to a length of L/2 (L1=L/2). Here, the length of L/2 in the first rib unit 130 corresponds to a length from one end of the unit rib to the bent portion thereof.

The first guide portion 152 may have a half of the overall length of the unit rib 132. In this case, since the first guide portion 152 is not bent, the cooling air may flow through the inner lower surface, upper surface, and the side surface 104 of the cooling passage associated with the first guide portion 152 when it flow to the direction-changing portion 102

Accordingly, the cooling efficiency of the blade 100 is not deteriorated due to the increase in contact surface area of the cooling air especially in the direction-changing portion 102, resulting in the stable and effective cooling of the blade.

Referring to FIG. 2 or 5, when the second guide portion 154 has a length of L2 and each of the unit ribs 142 of the second rib unit 140 has a length of L in the present embodiment, the length of L2 is equal to a length of L/2 (L2=L/2).

For example, the second guide portion 154 may have a half of the overall length of the unit rib 142. In this case, since the second guide portion 154 is not bent, the cooling air may come into stable contact with the inner lower or upper surface (not shown) and the side surface 104 of the associated cooling passage 120 when it flow toward the unit rib 142 adjacent to the second guide portion 154.

Accordingly, the cooling efficiency of the blade 100 is not deteriorated due to the increase in contact surface area of the cooling air even after the cooling air passes through the direction-changing portion 102, giving rise to the stable and effective cooling of the blade.

In an embodiment, the first and second guide portions 152 and 154 may form an angle between 30° and 60° with respect to the inner wall of the turbine blade 100. Preferably, the first guide portion 152 may be obliquely disposed at an angle of 45°. This angle may be equal to an angle of inclination of the unit rib 132 adjacent to the first guide portion 152.

The unit rib 132 may include a plurality of unit ribs in the cooling passage 120 associated with the unit rib 132 and is positioned adjacent to the first guide portion 152. Therefore, the first guide portion 152 may have an angle of inclination similar or equal to that of the unit rib 132 to guide the stable flow of cooling air, allowing the cooling air to flow into a specific drop position.

Accordingly, heat exchange efficiency and the stable flow of the cooling air may be improved when the cooling air passes through the first guide portion 152 and the direction-changing portion 102.

The first and second guide portions 152 and 154 are disposed in an end portion of the partition wall 110 facing the direction-changing portion 102. The partition wall 110 does not extend to the direction-changing portion 102 but is maintained at a distance G spaced from the direction-changing portion 102.

According to an embodiment of the present invention, the distance G is not limited to a specific value, but it may be defined as a distance spaced from the maximum position at which the direction-changing portion 102 is rounded outward.

The partition wall 110 partitions the cooling passage 120. Thus, if the first and second guide portions 152 and 154 are disposed beyond the end of the partition wall 110, the cooling air may be disturbed or may develop to a vortex in the portion. Therefore, the first and second guide portions 152 and 154 are disposed at the above-mentioned positions.

In an embodiment, the first guide portion 152 may include a plurality of first guide ribs, which are disposed in a portion close to the direction-changing portion 102 and are spaced apart from each other, as illustrated in FIG. 3.

When the first guide portion 152 includes a plurality of first guide portions, the first guide portions 152 may have the same length. Otherwise, the first guide portions 152 may have different lengths. The first guide portions 152 may become shorter as they are closer to the direction-changing portion 102.

In the same manner, the second guide portion 154 may include a plurality of second guide ribs which are disposed in a portion close to the direction-changing portion 102 and are spaced apart from each other.

The second guide portion 154 may have one or more second guide portions so as to allow the cooling air to efficiently flow through the direction-changing portion 102. When the second guide portion 154 includes a plurality of second guide portions, the second guide portions 154 may have the same length. Otherwise, the second guide portions 154 may have different lengths, such as being shortened as they are away from the direction-changing portion 102.

The first and second guide portions 152 and 154 are responsible for guiding the cooling air to flow through the inner lower portion 103, the upper surface, and the side surface 104 of the cooling passage 120, thereby enhancing the cooling efficiency of the cooling air due to the increase in the contact surface area, i.e., heat exchange area.

Referring to FIG. 4, the first guide portion 152 may have the same protruding height as or a lower protruding height than the unit ribs 132 of the first rib unit 130.

For example, when the first guide portion 152 has the lower protruding height than the unit rib 132, the drop position of the cooling air may be shorter as compared to when the first guide portion 152 has the same protruding height as the unit rib 132.

Accordingly, it is possible to easily adjust the drop position to a specific position when the cooling air flows to the direction-changing portion 102, and it is possible to enhance the cooling efficiency through the increase in the contact surface area of the cooling air with the inner lower portion 103 or the upper surface (not shown) of the cooling passage 120.

Referring to FIG. 5, the second guide portion 154 may have the same protruding height as or a lower protruding height than each of the constituent unit ribs 142 of the second rib unit 140.

For example, when the second guide portion 154 has the lower protruding height than the unit rib 142, the drop position of cooling air may become shorter as compared to when the second guide portion 154 has the same protruding height as the unit rib 142.

Accordingly, it is possible to adjust the drop position to a specific position when the cooling air flows through the direction-changing portion 102, and it is also possible to enhance the cooling efficiency due to the increase in contact surface area of the cooling air with the inner lower or upper surface (not shown) of the cooling passage 120.

Referring to FIG. 6, the first rib unit ribs 132 may have shorter protruding heights as they are closer to the first guide portion 152. Since cooling efficiency may be deteriorated due to the plurality of unit ribs 132 of the first rib unit 130 when the direction of cooling air is changed in the direction-changing portion 102, it may be advantageous to enhance the cooling efficiency of the blade 100 by sufficiently performing heat exchange in the cooling passage 120, in which the unit ribs 132 are arranged, before the cooling air flows to the direction-changing portion 102.

The cooling passage in which the second rib unit 140 is disposed may have a smaller width than the cooling passage in which the first rib unit 130 is disposed. In this case, the unit ribs 142 of the second rib unit 140 may be configured such that the number of unit ribs of the second rib unit 140 is larger than that of unit ribs of the first rib unit 130.

In the portion of the cooling passage in which a unit rib 142 is disposed, the cooling passage has a decreased area and the velocity of cooling air is changed, it may be preferable to arrange a plurality of unit ribs 142 in the above portion to improve heat exchange efficiency through an increase in area.

Accordingly, the cooling efficiency of the blade 100 is enhanced since heat exchange is stably performed regardless of the reduction in area of the cooling passage 120.

Referring to FIG. 7, the protruding heights of the unit ribs 142 of the second rib unit 140 may have shorter protruding heights as they are closer to the second guide portion 154.

The area of the cooling passage 120 in which the unit ribs 142 are disposed is reduced. Therefore, it is possible to improve heat exchange efficiency between cooling air and the inner lower and upper surfaces of the cooling passage 120 while the cooling air passes through the unit ribs 142, resulting in the enhancement of the total cooling efficiency of the blade 100.

The unit ribs 142 of the second rib unit 140 are disposed in a larger number than the unit ribs 132 of the first rib unit 130. Therefore, the cooling efficiency of the blade is not deteriorated but the blade is stably cooled. The number of unit ribs 142 is not limited to a specific value, and may be modified into other numbers according to an embodiment of the present invention.

Referring to FIG. 8, the direction-changing portion 102 has an auxiliary rib 160 to allow the cooling air to efficiently pass through the first guide portion 152.

The auxiliary rib 160 may have a curvature corresponding to the rounded curvature of the direction-changing portion 102 to promote the stable flow of cooling air.

The auxiliary rib 160 may include a plurality of auxiliary ribs disposed in the rounded portion of the direction-changing portion 102, or may be disposed adjacent to the first guide portion 152 to guide the flow direction of the cooling air passing through the first guide portion 152.

The auxiliary rib 160 may also be disposed adjacent to the second guide portion 154 to guide the direction of the cooling air flowing to the second guide portion 154 to a specific position.

Accordingly, the heat exchange and cooling air flow may be stably performed in the direction-changing portion 102 to enhance the total cooling efficiency of the blade 100.

Also, the auxiliary rib 160 may consist of a plurality of auxiliary ribs that are spaced apart from the partition wall 110 and have different lengths.

For example, the auxiliary ribs 160 face the partition wall 110 and are spaced apart from each other in the downward direction, as shown in the drawing.

When the cooling air flows toward the direction-changing portion 102, the direction of the cooling air may be changed to the second rib unit 140 having multiple unit ribs 142 by the auxiliary ribs 160.

When the direction of cooling air is changed, the flow of the cooling air can be guided as much as possible by the unit ribs 132 and 142 in the blade 100 for enhancement of cooling efficiency.

To this end, the main flow of the cooling air is guided toward the second rib unit 140 by the direction-changing portion 102 and the auxiliary flow of cooling air is guided by the auxiliary ribs 160, thereby achieving the stable cooling air flow.

Accordingly, the cooling air can be easily guided from position A to position C in the turbine blade 100 according to an embodiment of the present invention, and the cooling efficiency of the turbine blade 100 can be stably maintained.

As is apparent from the above description, the exemplary embodiments of the present invention can improve the stable flow of the cooling air within a turbine blade to thus enhance the cooling efficiency of the turbine blade.

The exemplary embodiments of the present invention can improve cooling efficiency at a position where the flow direction of cooling air is changed in the turbine blade.

The exemplary embodiments of the present invention can stably maintain the cooling efficiency of the turbine blade in all sections regardless of the internal structure of the turbine blade.

While the present invention has been described with respect to the specific embodiments, it will be apparent to those skilled in the art that various changes and modifications may be made without departing from the spirit and scope of the invention as defined in the following claims.

What is claimed is:

1. A gas turbine blade comprising:

a plurality of cooling passages formed by a partition wall partitioning an internal region of the gas turbine blade, the plurality of cooling passages including a first cooling passage and a second cooling passage communicating with the first cooling passage at a distal end of an end portion of the partition wall, the first cooling passage configured to receive cooling air flowing through the first cooling passage in a first longitudinal direction, the second cooling passage configured to receive cooling air flowing through the second cooling passage in a second longitudinal direction opposite to the first longitudinal direction;

a plurality of first unit ribs disposed in the first cooling passage and arranged along a first longitudinal axis of the first cooling passage, the plurality of first unit ribs including a final unit rib disposed adjacent to the end portion of the partition wall, each of the plurality of first unit ribs having a V-shape formed by two sides that are joined at a vertex that is disposed on the first longitudinal axis of the first cooling passage and that faces upstream toward the cooling air flowing through the first cooling passage;

a plurality of second unit ribs disposed in the second cooling passage and arranged along a first longitudinal axis of the second cooling passage, the plurality of second unit ribs including an initial unit rib disposed adjacent to the end portion of the partition wall, each of the plurality of second unit ribs having a V-shape formed by two sides that are joined at a vertex that is disposed on the first longitudinal axis of the second cooling passage and that faces upstream toward the cooling air flowing through the second cooling passage;

at least one first rectilinear rib that is disposed on one side of the first longitudinal axis of the first cooling passage adjacent to the final unit rib of the plurality of first unit ribs and that includes an upstream end and a downstream end opposite to the upstream end, each of the at least one first rectilinear rib formed to be parallel to a corresponding one of the two sides forming the V-shape of the final rib unit of the plurality of first unit ribs, such that the upstream end of the at least one first rectilinear rib is disposed adjacent to the vertex of the V-shape of the final rib unit of the plurality of first unit ribs and such that the downstream end of the at least one first rectilinear rib is disposed adjacent to a downstream end of the corresponding one of the two sides forming the V-shape of the final rib unit of the plurality of first unit ribs; and at least one second rectilinear rib that is disposed on one side of the first longitudinal axis of the second cooling passage adjacent to the initial unit rib of the plurality of second unit ribs and that includes an upstream end and a downstream end opposite to the upstream end, each of the at least one second rectilinear rib formed to be parallel to a corresponding one of the two sides forming the V-shape of the initial rib unit of the plurality of second unit ribs, such that the upstream end of the at least one second rectilinear rib is disposed adjacent to the vertex of the V-shape of the initial rib unit of the plurality of second unit ribs and such that the downstream end of the at least one second rectilinear rib is disposed adjacent to a downstream end of the corresponding one of the two sides forming the V-shape of the initial rib unit of the plurality of second unit ribs.

2. The gas turbine blade according to claim 1, wherein each of the plurality of first unit ribs includes one side of the V-shape extending from the first longitudinal axis of the first cooling passage to a second longitudinal axis of the first cooling passage, and each of the plurality of second unit ribs includes one side of the V-shape extending from the first longitudinal axis of the second cooling passage to a second longitudinal axis of the second cooling passage; and wherein the first rectilinear rib is disposed between the first and second longitudinal axes of the first cooling passage, and the second rectilinear rib is disposed between the first and second longitudinal axes of the second cooling passage.

3. The gas turbine blade according to claim 1, wherein each of the at least one first rectilinear rib has a length (L1) that is shorter than a length (L) of any one of the plurality of first unit ribs.

4. The gas turbine blade according to claim 3, wherein the length (L1) of each of the at least one first rectilinear rib is substantially equal to a length of L/2 (L1=L/2).

5. The gas turbine blade according to claim 1, wherein each of the at least one second rectilinear rib has a length (L2) that is shorter than a length (L) of any one of the plurality of second unit ribs.

6. The gas turbine blade according to claim 5, wherein the length (L2) of each of the at least one second rectilinear rib is substantially equal to a length of L/2 (L2=L/2).

7. The gas turbine blade according to claim 1, wherein each of the at least one second rectilinear rib and the at least one second rectilinear rib forms an angle between 30° and 60° with respect to an inner wall of the gas turbine blade.

8. The gas turbine blade according to claim 1, wherein the at least one first rectilinear rib includes a plurality of first rectilinear ribs that are spaced apart from each other, and the at least one second rectilinear rib includes a plurality of second rectilinear ribs that are spaced apart from each other.

9. The gas turbine blade according to claim 1, wherein each of the at least one first rectilinear rib has a protruding height that is not greater than a protruding height of the plurality of first unit ribs.

10. The gas turbine blade according to claim 9, wherein the protruding height of the plurality of first unit ribs is gradually reduced from an initial unit rib of the plurality of first unit ribs to the final unit rib of the plurality of first unit ribs.

11. The gas turbine blade according to claim 1, wherein each of the at least one second rectilinear rib has a protruding height that is not greater than a protruding height of the plurality of second unit ribs.

12. The gas turbine blade according to claim 11, wherein the protruding height of the plurality of second unit ribs is gradually reduced from the initial unit rib of the plurality of second unit ribs to a final unit rib of the plurality of second unit ribs.

13. The gas turbine blade according to claim 1, wherein the plurality of first unit ribs have a protruding height that is gradually reduced in a direction of cooling air flowing in the first cooling passage, and wherein the plurality of second unit ribs have a protruding height that is gradually increased in a direction of cooling air flowing in the second cooling passage.

14. The gas turbine blade according to claim 1, wherein the second cooling passage has a width less than a width of the first cooling passage.

15. The gas turbine blade according to claim 14, wherein the plurality of second unit ribs number greater than the plurality of first unit ribs.

16. The gas turbine blade according to claim 1, further comprising:

a direction-changing portion disposed between first cooling passage and a second cooling passage and configured to change a direction of cooling air flowing through the first cooling passage to a direction of cooling air flowing through the second cooling passage; and an auxiliary rib disposed in the direction-changing portion and configured to guide a flow of the cooling air passing through the plurality of first unit ribs of the first cooling passage.

17. The gas turbine blade according to claim 16, wherein the auxiliary rib has a curvature corresponding to a rounded curvature of the direction-changing portion.

18. The gas turbine blade according to claim 16, wherein the auxiliary rib includes a plurality of auxiliary ribs having different lengths.

19. The gas turbine blade according to claim 16, wherein the auxiliary rib is spaced apart from the distal end of the end portion of the partition wall.

20. A gas turbine blade comprising:

a plurality of cooling passages formed by a partition wall partitioning an internal region of the gas turbine blade, the plurality of cooling passages including a first cooling passage and a second cooling passage communicating with the first cooling passage at a distal end of an end portion of the partition wall, the first cooling passage configured to receive cooling air flowing through the first cooling passage in a first longitudinal direction, the second cooling passage configured to receive cooling air flowing through the second cooling passage in a second longitudinal direction opposite to the first longitudinal direction;

a plurality of first unit ribs disposed in the first cooling passage and arranged along a first longitudinal axis of the first cooling passage, the plurality of first unit ribs including a final unit rib disposed adjacent to the end portion of the partition wall, each of the plurality of first unit ribs having a V-shape whose vertex is disposed on the first longitudinal axis of the first cooling passage and faces upstream toward the cooling air flowing through the first cooling passage and including one side of the V-shape extending from the first longitudinal axis of the first cooling passage to a second longitudinal axis of the first cooling passage;

a plurality of second unit ribs disposed in the second cooling passage and arranged along a first longitudinal axis of the second cooling passage, each of the plurality of second unit ribs having a V-shape whose vertex is disposed on the first longitudinal axis of the second cooling passage and faces upstream toward the cooling air flowing through the second cooling passage and including one side of the V-shape extending from the first longitudinal axis of the second cooling passage to a second longitudinal axis of the second cooling passage;

a first rectilinear rib that is disposed adjacent to the final unit rib of the plurality of first unit ribs between the first and second longitudinal axes of the first cooling passage and that includes an upstream end and a downstream end opposite to the upstream end, the upstream end of the first rectilinear rib extending to the first longitudinal axis of the first cooling passage, the downstream end of the first rectilinear rib extending to the second longitudinal axis of the first cooling passage; and a second rectilinear rib that is disposed adjacent to the initial unit rib of the plurality of second unit ribs between the first and second longitudinal axes of the second cooling passage and that includes an upstream end and a downstream end opposite to the upstream end, the upstream end of the second rectilinear rib extending to the first longitudinal axis of the second cooling passage, the downstream end of the second rectilinear rib extending to the second longitudinal axis of the second cooling passage.

* * * * *